United States Patent [19]

Kokta

[11] Patent Number: 4,798,651

[45] Date of Patent: Jan. 17, 1989

[54] PROCESS FOR PREPARING PULP FOR PAPER MAKING

[75] Inventor: Bohuslav Kokta, Three Rivers, Canada

[73] Assignee: Stake Technology Ltd., Oakville, Canada

[21] Appl. No.: 79,928

[22] Filed: Jul. 31, 1987

[30] Foreign Application Priority Data

Mar. 24, 1987 [CA] Canada ..... 523871

[51] Int. Cl.[4] ..... D21B 1/36; D21C 3/00; D21C 3/04

[52] U.S. Cl. ..... 162/22; 162/78; 162/84; 162/86

[58] Field of Search ..... 162/84, 83, 86, 21, 162/22, 78

[56] References Cited

FOREIGN PATENT DOCUMENTS

| | | | |
|---|---|---|---|
| 556962 | 6/1958 | Canada . | |
| 919468 | 1/1973 | Canada | 92/56 |
| 1070537 | 1/1980 | Canada | 92/59 |
| 1070646 | 1/1980 | Canada | 222/84.3 |
| 1096374 | 2/1981 | Canada | 260/133 |
| 1096559 | 3/1981 | Canada | 9/2 |
| 1119033 | 2/1982 | Canada | 92/57.3 |
| 1138708 | 4/1983 | Canada | 100/8 |

OTHER PUBLICATIONS

Explosion Pulping of Annual and Fast Growing Plants, Mamers, Menz et al Appita Nov. 1979, p. 201.

Possibilities for Reduction of Energy Requirements during Chip Refining Puri and Higgins, Appita vol. 37, No. 6, p. 496, May 1984.

The Siropulper-a New Concept in Wastepaper Recovery, Mamers. Appita, vol. 32, No. 2, Sep. 1978.

New Pulping Process Solves Paper Recycling Problems Canadian Pulp and Paper Industry, vol. 32, No. 19,:79 (Nov. 1979).

Asplund Svenk Pappersted (1953) 56, 550.

Higgins et al Appita 32(3) 187-200 (Nov. 1978).

*Primary Examiner*—Peter Chin

*Assistant Examiner*—Thi Dang

*Attorney, Agent, or Firm*—Cushman, Darby & Cushman

[57] ABSTRACT

This invention relates to an improved process for preparing pulp suitable for paper making. Although processes using explosive decompression have been known in the past, it has been believed that these must be conducted at relatively low temperatures. Although such known processes of explosive decompression resulted in a saving of power, the physical strength was low, the color was relatively dark and there was a considerable yield loss. This invention is to provide a process to achieve the saving of power resulting from the use of explosive decompression but in which there is good brightness, high yield and good fiber strength. The process of this invention defines conditions for achieving these objectives. These conditions include impregnation of the chips of other wood fragments under specified conditions and cooking with saturated steam at a high temperature and pressure followed by explosive decompression and refining.

23 Claims, No Drawings

PROCESS FOR PREPARING PULP FOR PAPER MAKING

This invention relates to an improved process for preparing pulp suitable for paper making.

BACKGROUND

The factors for importance in processes for preparing pulp include:

(1) physical properties of the fiber which carry over to the paper product to give satisfactory strength. These are conventionally evaluated in terms of burst, tear, and breaking length.

(2) freeness which is related to dewatering on conventional paper making equipment.

(3) brightness—It is desirable for most purposes that the paper made from the pulp be white or at least light coloured. The greater the brightness of the pulp the less the cost of chemicals for bleaching.

(4) yield—The higher the yield, the greater cost efficiency in the utilization of forest products.

(5) chemical consumption—Chemicals are required for pulping processes but these are costly and it is therefore desirable to minimize chemical consumption and also to use chemicals which are available at a reasonable cost.

(6) time of pulping. This also affects cost in that it involves the use of costly equipment and energy in terms of heat input to maintain the cooking temperature.

(7) refining energy—The cost of the energy required for pulping processes that include mechanical refining is an important cost factor.

Chemical pulping leads to strong papers, but is costly in terms of low yield and high chemical consumption. There are also accompanying problems of pollution abatement.

Mechanical pulping provides good yields but the refining costs are high, especially in the case of thermo mechanical pulping (TMP) and refiner mechanical pulping (RMP) and the strength of paper produced is rather low. In the case of groundwood, even though the defibrating energy is low, the pulp and paper properties are so low that it can be used only in admixture with other pulps.

There has been increased interest in recent years in so-called chemimechanical or semi-chemical processes which provide pulps of a strength that is adequate for most purposes and in which the yield is of the order of 90% or more. The drawback is, however, the high power requirements for the mechanical refining part of the chemimechanical or semi-chemical process due to the high percentage of lignin and fiber stiffness. The chips are not as soft as those produced by chemical pulping.

An alternative to high energy mechanical refining in equipment such as a disc refiner, is to soften wood chips with steam under high pressure followed by explosive decompression. This was indeed the process invented by Mason in the 1920's and used for hardboard manufacture. Chips were steamed at low pressure for about one minute then at high pressure for two minutes, and then brought to an even higher pressure followed by discharge of superheated chips to atmospheric pressure to explode the chips into a pulp called gun stock which was then further refined. Although the pulp resulting from the Mason process had high freeness and bulk and although the step of explosive decompression resulted in a saving of the power needed for further refining, the physical strength, as evaluated in terms of burst, tear and breaking length, was low. The fibers were therefore unsuitable for papermaking. Another problems was the relatively dark colour which would have required excessive chemical consumption for bleaching. There was also considerable yield loss due to acidic hydrolytic degradation due to the wood acids liberated at the high temperature used.

According to Asplund Svensk Papperstid (1953) 56,550 pulp with good paper making properties can be produced by a process involving explosive decompression if the steam temperature is controlled to between 100° C. and 160° C. Higgins et al in Appita 32(3) 187-200 (November 1978) suggested that the Asplund process could be improved if the chips were chemically pretreated and the steam temperature was limited to less than 130° C. In Higgins' modification of the Asplund process the pressure at a temperature of 130° C. will be about 1.5 atmospheres.

OBJECTS

The object of this invention is to provide a process in which the energy saving advantage of explosive decompression is achieved but in which good brightness, high yield, and good fiber strength are also maintained.

It is also an object to provide a process that is conducted at higher temperatures than those considered to be desirable according to the publications of Asplund and Higgins referred to above. The higher temperatures enable higher pressures to be used, thereby greatly improving steam penetration inside the fibers and softening of the hydrogen bonds in the mainly crystalline region of the fibers.

The Invention

The major problems accompanying previous processes using explosive decompression are believed to have been the degradation due to the oxidation of wood and acid hydrolysis leading to loss in brightness, deterioration of fiber and paper properties and loss of yield. The approach adopted by this invention is therefore to attempt to curtail hydrolytic and oxidative wood degradation and thereby to protect against loss of yield, brightness and fiber strength. The loss of fiber strengh will be particularly great if the degree of polymerization of the cellulose falls below the critical value which is about 500-600. Hydrolytic degradation will also cause yield loss due mainly to degradation of hemi-cellulose.

The process of this invention tries to achieve a positive improvement in the strength of the paper that will be produced from the fibers by increasing the number of hydrophilic groups on the fiber surfaces thereby adding to the potential sites for hydrogen bonding.

The conditions for the achievement of the foregoing objects in accordance with the process of this invention are as follows:

(1) The wood fragments, having fibers suitable for paper making, such as chips, are in a form in which thorough chemical impregnation can be achieved in a reaonable time.

(2) There is an initial thorough impregnation of the chips or other wood fragments by an alkaline aqueous liquor having at least one agent acting to produce hydrophilic groups and as an antioxidant which is capable of protecting the chips against oxidation and develops hydrophilic groups during the cooking stage. The same chemical may act as both an agent to produce hydrophilic groups and as an antioxidant or these functions may be performed by separate chemicals. At the end of cooking the pH should not be lower than about 6.0, so that acids released during cooking will be neutralized. Preferably a swelling agent is also used in the case of high density wood.

(3) The impregnated chips are cooked using saturated steam in the substantial absence of air at high temperature and pressure.

(4) The chips that have been steam cooked are subjected to explosive decompression to result in chips which are softened and partially defibrated.

(5) The softened chips are preferably washed and then without undue delay, and preferably immediately, refined to provide pulp.

The steps of the process of this invention which will for convenience be referred to as the improved explosion process, will now be considered in more detail.

The Wood Fragments

The starting material will normally be chips in which the fibers are of a length suitable for paper making. Shavings could also be used but sawdust would be undesirable except as a minor part of the total furnish as the fibers are partially cut.

The chips should also, as is well known, be suitable in the sense of being free from bark and foreign matter.

It is desirable for the purposes of this invention that coarse chips be avoided as otherwise the subsequent impregnation may deposit chemicals only on the chip surface, unless impregnation is carried out for a very long time. Another problem with coarse chips is that cooking would not be complete. It is best to use shredded or thin chips. In the examples, except where otherwise stated, industrial softwood chips were used which were 75% spruce, 20% fir and 5% aspen. These were shredded, the energy for which was of the order of 0.1 MJ/kg. It has been found that this process is applicable also to hardwoods, jack pine and larch, giving 50% stronger papers at only 40% of refiner energy compared with conventional chemo-thermo mechanical pulping.

Impregnation

The purpose of impregnation is to protect the chips against oxidation during cooing and during transfer from the cooking vessel to the refiner. It is also an objective to provide a positive increase in strength by developing hydrophylic groups on the fiber surface during steam treatment. This will then provide additional sites for hydrogen bonding.

The preferred anti-oxidant is sodium sulphite $Na_2SO_3$ which also forms hydrophilic groups, and which is available at a low cost. It is used to provide a concentration of absorbed chemical of about 1 to 10%. Concentrations below 4% would be used where brightness protection is unimportant and high strength is not required. Where, however, brightness is important the sodium sulphite should be at least 4%. If physical properties are important thesa will be improved by using a coneentration of at least 4% sodium sulphite and will be further improved as the concentration is further increased towards 10%. The concentratipn of the solution is preferably about the same as percent of chemical to be absorbed where there are equal quantities of chips and liquor. For example, a ton of chips of 50% consistency mixed with one ton of 8% solution will result in 8% absorbed on the pulp. Of importance is thorough impregnation to distribute the antioxidant evenly rather than depositing it just on the surface. Other antioxidants that can be used are potassium sulphite or magnesium sulphite. Ammonium sulphite could be used if cooking conditions are not severe or with a buffer. Complexing agents such as ethylene diamine tetracetic acid (EDTA), sodium diethylene triaminepentacetate (DTPA), sodium tripolyphosphate (TPF) and other complexing agents known in the art as being usable under alkaline conditions may be added to minimize the catalytic effect of metals such as iron on oxidative degradation.

It is desirable also to use a swelling agent to assist the antioxidant or hydrophilic agent in penetrating the wood and this contributes also to softening the chip. This is of particular value in the case of high density wood. Suitable swelling agents are sodium or potassium hydroxide and ammonium hydroxide which will contribute also to providing hydrophilic groups. Other swelling agents that can be used and which may be desirable as auxiliary swelling agents for high density wood are zinc chloride, sodium chloride, sodium bromide, calcium isocyanate, Schweitzers' solution, cupriethylenediamine (C.E.D) tetraethylammonium hydroxide, dimethyldibenzylammonium hydroxide. The concentration of swelling agent and conditions of swelling must be controlled in such a way as to avoid any dissolution of the hollocellulose. Thus the percentage of swelling agent in the impregnating solution will be in the range of about 1 to 4% depending on the agent and the conditions.

The impregnating solution must be alkaline and have enough free hydroxyl to be able to neutralize the liberated wood acids such as formic acid and acetic acid. Normally the starting pH is about 7.5 or higher and the final pH after steam cooking should be at least 6 or higher.

The time of impregnation at atmospheric pressure in holding tanks typically ranges from about 12 hours to 24 hours at a temperature of about 30° C. to 60° C. Approximately equal weights of chips and of aqueous impregnating solution can be used. For industrial purposes, however, the time may be shortened to an hour or to minutes by impregnating with steam under pressure and at a higeer temperature. The pressure should be up to about 1 atmospheric extra pressure at a temperature of about 100° C. to 110° C. To improve impregnation the chips should be compressed in advance of impregnation. Under these conditions, penetration will be achieved in a shorter time, but penetration is what predominantly occurs. There is no significant cooking.

In the examples, unless otherwise stated, 150 grams of chips were mixed in plastic bags with 150 g. of an aqueous solulion of the specified concentration of the chemicals indicated in the examples. The time of impregnation was 24 hours and the temperature of impregnation was 60° C. for softwood and 48 hours and 600° C. for hardwood. The foregoing is applicable only on a laboratory scale. In industry the impregnation time would be shortened as described above.

Steam Cooking

The impregnated chips are steam cooked at a high temperature and pressure.

Equipment and methods that can be used for preliminary compacting of the impregnated chips, for cooking the chips with steam and for the discharge of the chips under conditions of explosive decompression are described in Canadian patent Nos. 1,070,537 dated Jan. 29, 1980; 1,070,646 dated Jan. 29, 1980; 1,119,033 dated Mar. 2, 1982 and 1,138,708 dated Jan. 4, 1983, all of which were granted to Stake Technology Ltd. The equipment used in the examples was acquired from that company.

The temperature of cooking should be within the range of about 170° C. to 210° C. and preferably within the range 180°–195° C., which is in excess of the temperatures considered possible according to the publications of Asplund and Higgins previously referred to. These temperatures correspond with a pressure of 7.9 atmospheres for 170° C. and 15.5 atmospheres for 200° C. It is these high pressures which make a very important contribution to ensuring excellent penetration of the chips by the cooking liquor.

The cooking may be preceded by steam flushing under low pressure steam at 100° C for a short period such as one minute. This is a matter of convenience, in that with a batch reactor the cooking vessel is initially open to the atmosphere, to eliminate air. This air would be disadvantageous in that it would result in oxidation if it were trapped in the cooking vessel. Additional antioxidant may if desired be added at this stage. Steam flushing is desirable with a batch reactor but would not be necessary for a continuous reactor.

This preliminary treatment is then followed by cooking for about 30 seconds to 6 minutes and preferably about 1 to 4 minutes.

It has been found that within reasonable limits there is a property improvement by increasing the time—temperature (K). By increasing this constant from 285 to 760 in the case of black spruce at about the same freeness (157–167) the burst index increased from 3.15 to 4.41 and breaking length from 6.3 to 7.6 and tear from 5.6 to 5.8. Refining energy dropped from 3.2 to 3.1 and brightness dropped from 53.7 to 49.1 (equivalent to 59.7 to 55.1. These figures are adjusted to those that ordinarily would be obtained by using an industrial refiner in place of a laboratory refiner. Impregnation was with 8% sodium sulphite and ½% of DTPA.

Explosive Decompression

After cooking the pressure is instantaneously released and the chips are exploded into a release vessel. If there is to be a delay between release of the chips and refining it is important to cool the chips down by washing them. Washing may also be desirable for the purpose of chemical recovery.

It is desirable immediately to refine the chips after explosive decompression. Otherwise, if the chips are stored, some oxidation will occur with resultant loss of brightness. The rapidity with which this will occur depends on how much residual antioxidant is present at that time and on the temperature of the chips and the extent of exposure to oxygen. Preferably, therefore, refining is immediate so that it is unnecessary to incur the cost of excess antioxidant. In any event, undue delay should be avoided. Such delay is regarded as being undue if oxidation takes place to an extent that will materially affect brightness.

The chips resulting from the explosive decompression are softened and partially defibrated.

Refining

Refining in the experiments described below and labelled "PFI" was conducted at a 10% consistency level according to TAPPI standards using an atmospheric laboratory refiner. The refining energy reported is the industrial energy obtained by dividing the PFI energy by factor 3.5. In most cases however, laboratory refining was conducted at 2% consistency level using a blender coupled with an energy meter model EW 604.

According to A. C. Shaw "Simulation of Secondary Refining" Pulp and Paper Canada 85'6 T 152-T155 (1984) the blender results closely match those obtained with industrial refiners. Properties were evaluated after preparing paper sheets according to standard CPPA testing methods.

Refining erergies are unusually low and can be expected to be in the range 3.6 to 4 MJ/kg to provide a freeness of about 700 and about 4.6 to 5 MJ/kg for a freeness of 100 which is about one half of the energy demand of refiner mechanical pulp (RMP) or thermomechanical pulp (TMP). In the case of chemi-mechanical pulp (CMP) the refiner energy is about 40% higher than that of explosion pulp for the same properties. Moreover, physical properties such as burst, tear and breaking length will be considerably better than those of CMP as illustrated below in Table 1.

TABLE 1

PAPER PROPERTIES OF IMPROVED EXPLOSION AND CMP PULPS

| REFINER PULP | BLENDER *IMPROVED EXPLOSION | +SUNDS IMPROVED EXPLOSION | ++BAUER IMPROVED EXPLOSION | SUNDS (1) IMPROVED EXPLOSION | SUNDS **CMP | SUNDS (1) CMP |
|---|---|---|---|---|---|---|
| CSF (ml) | 704 | 702 | 687 | 590 | 282 | 72 |
| ENERGY | 3.6 | 3.96 | 4.0 | 5.0 | 5.1 | 8.75 |
| BRIGHTNESS | 47.3 | 51.9 | 52.1 | 51.3 | 57 | 55.4 |
| OPACITY (%) | 92 | 88.5 | 88.5 | 89.2 | 87.8 | 86.7 |
| BULK ($cm^3/g$) | 3.48 | 3.26 | 2.77 | 2.78 | 1.77 | 1.84 |
| POROSITY (ml/min) | 5302 | 5140 | 4980 | 4600 | 1585 | 54 |
| BURST ($mN \cdot m^2/g$) | 2.34 | 2.54 | 2.56 | 2.81 | 1.77 | 2.79 |
| BREAKING LENGTH | 3.7 | 4.37 | 3.7 | 5.3 | 3.5 | 5.5 |
| STRETCH (%) | 1.54 | 1.58 | 1.67 | 1.68 | 2.25 | 2.4 |

TABLE 1-continued

| PAPER PROPERTIES OF IMPROVED EXPLOSION AND CMP PULPS | | | | | | |
|---|---|---|---|---|---|---|
| REFINER PULP | BLENDER *IMPROVED EXPLOSION | +SUNDS IMPROVED EXPLOSION | ++BAUER IMPROVED EXPLOSION | SUNDS (1) IMPROVED EXPLOSION | SUNDS **CMP | SUNDS (1) CMP |
| TEAR | 13.8 | 14.5 | 13.8 | 11.7 | 10.1 | 6.4 |

**Improved Explosion: 8% $Na_2SO_3$; 190° C.; 4 min, (75% Spruce; 20% fir; 5% Aspen)
Yield 91.3%
**CMP: 13% $Na_2SO_3$; 160° C.; 110 min; (75% Spruce; 20% Fir; 5% Aspen)
Yield: 87%
+Sunds: Sunds Defibrator, 1000 kg/day,
++Bauer: Bauer Defribrator, 4500 kg/day
(1) 2 Stage Refining In Table 2, a comparison is provided at similar burst between the properties of the improved explosion process as compared with TMP or CTMP processes. It will be noted that brightness is comparable and physical properties are improved with far less expenditure of energy.

Table 3 shows a correlation between refining energy and other factors such as cooking time and concentration of sodium sulphite together with the physical properties. It also indicates the balance between factors such as cooking time and chemical content as against the refining energy required to achieve a given freeness.

TABLE 2

| COMPARISON OF PAPER PROPERTIES | | | | |
|---|---|---|---|---|
| DEFIBRATOR PULP | BLENDER *IMPROVED EXPLOSION | BAUER *IMPROVED EXPLOSION | SUNDS TMP (1)** | SUNDS **CTMP (1) |
| FREENESS (ml) | 704 | 687 | 130–140 | 180–260 |
| ENERGY (MJ/kg) | 3.6 | 4.0 | 9.4 | 8.4 |
| BRIGHTNESS (%) | 47.3 (+54) | 52.1 | 54.5 | 59.0 |
| OPACITY (%) | 92 | 88.5 | 93.2 | 90.3 |
| BULK ($cm^3/g$) | 3.48 | 2.77 | 3.5 | 3.2 |
| POROSITY (ml/min) | 5302 | 4980 | — | — |
| BURST ($kPa.m^2/g$) | 2.34 | 2.56 | 2.2 | 2.2 |
| TEAR ($mN \cdot m^2/g$) | 13.8 | 13.8 | 8.3 | 10 |
| RUPTURE (km) | 3.7 | 3.7 | — | — |
| STRETCH (%) | 1.54 | 1.67 | — | — |

+Brightness 54% if the defibrator had been the Sunds-Defibrator
*8% $Na_2SO_3$; 190° C.; 4 min; soft wood (75% Spruce; 20% fir; 5% aspen)
**100% spruce; 2% $Na_2SO_3$ for CTMP; Pressure 250 kPa; Time: 5 min.
(1) D. Laliberte; P. M. Shalhorn; A. Karnis. Comparison of TMP and CTMP properties from spruce and pine sawmill chips. Proceeding of Papers, 72nd CPPA annual meeting, p. 159–166 *1986.

TABLE 3

| PROPERTIES OF BLACK SPRUCE IMPROVED EXPLOSION PULPS | | | | | | | | | |
|---|---|---|---|---|---|---|---|---|---|
| $Na_2SO_3$ % | $Na_2SO_3$ ml | DTPA % | **COOKING TIME min. | PFI rev. | CSF ml | *REFINING ENERGY MJ/kg | BRIGHTNESS*** % | OPACITY % | SCATTERING COEFFICIENT $Cm^2/g$ |
| 1 | 150 | 1 | 1.5 | 20 000 | 465 | 1.52 | 48.1 | 93.7 | 408 |
| | | | | 40 000 | 321 | 2.88 | 48.8 | 94.3 | 435 |
| | | | | 55 000 | 259 | 4.27 | 48.5 | 94.5 | 436 |
| 1 | 150 | 1 | 4 | 20 000 | 374 | 1.86 | 38.5 | 96.8 | 404 |
| | | | | 40 000 | 180 | 2.77 | 38.6 | 97.0 | 416 |
| | | | | 55 000 | 149 | 4.58 | 39.0 | 97.5 | 431 |
| 4 | 150 | 0.5 | 1.5 | 20 000 | 521 | 1.57 | 54.9 | 89.4 | 397 |
| | | | | 40 000 | 314 | 2.32 | 55.1 | 89.7 | 407 |
| | | | | 55 000 | 194 | 2.35 | 55.3 | 90.4 | 417 |
| 4 | 150 | 0.5 | 4 | 20 000 | 502 | 1.77 | 49.5 | 91.4 | 381 |
| | | | | 40 000 | 264 | 2.52 | 49.2 | 91.6 | 384 |
| | | | | 55 000 | 192 | 3.04 | 49.3 | 92.0 | 389 |
| 8 | 150 | 0.5 | 1.5 | 20 000 | 513 | 1.48 | 54.2 | 88.8 | 373 |
| | | | | 40 000 | 327 | 2.91 | 54.3 | 88.7 | 376 |
| | | | | 55 000 | 167 | 3.23 | 53.7 | 88.9 | 373 |
| 8 | 150 | 0.5 | 4 | 20 000 | 535 | 1.68 | 50.0 | 89.1 | 349 |
| | | | | 40 000 | 212 | 2.42 | 49.3 | 88.5 | 332 |
| | | | | 55 000 | 157 | 3.11 | 49.1 | 88.6 | 332 |

| $Na_2SO_3$ % | $Na_2SO_3$ ml | BULK $Cm^3/g$ | POROSITY ml/min. | BURST INDEX KP $m^2/g$ | TEAR INDEX $nM \cdot m^2/g$ | BREAKING LENGTH Km | STRETCH % |
|---|---|---|---|---|---|---|---|
| 1 | 150 | 3.15 | 4432 | 0.61 | 2.32 | 1.58 | 0.73 |
| | | 3.07 | 2620 | 0.58 | 2.54 | 1.75 | 0.68 |
| | | 2.84 | 1935 | 0.73 | 2.76 | 2.18 | 0.79 |
| 1 | 150 | 2.82 | 2477 | 0.83 | 3.80 | 2.39 | 0.90 |
| | | 2.47 | 616 | 1.33 | 4.03 | 3.34 | 1.12 |

TABLE 3-continued

PROPERTIES OF BLACK SPRUCE IMPROVED EXPLOSION PULPS

| | | | | | | | |
|---|---|---|---|---|---|---|---|
| | | 2.41 | 327 | 1.43 | 4.23 | 3.56 | 1.15 |
| 4 | 150 | 3.15 | 4292 | 0.98 | 4.52 | 2.57 | 1.00 |
| | | 2.63 | 1435 | 1.51 | 4.61 | 3.34 | 1.03 |
| | | 2.51 | 423 | 1.74 | 4.91 | 4.19 | 1.41 |
| 4 | 150 | 2.79 | 3318 | 1.56 | 6.24 | 3.87 | 1.40 |
| | | 2.35 | 575 | 2.30 | 6.08 | 4.98 | 1.64 |
| | | 2.26 | 232 | 2.60 | 5.60 | 5.39 | 1.86 |
| 8 | 150 | 2.72 | 2690 | 2.08 | 6.46 | 4.55 | 1.49 |
| | | 2.47 | 943 | 2.47 | 5.63 | 5.15 | 1.68 |
| | | 2.23 | 159 | 3.15 | 5.59 | 6.31 | 2.01 |
| 8 | 150 | 2.51 | 2135 | 3.41 | 7.25 | 6.03 | 1.91 |
| | | 2.19 | 188 | 4.20 | 6.09 | 7.28 | 2.22 |
| | | 2.08 | 68 | 4.41 | 5.81 | 7.63 | 2.32 |

*Refining energy includes blending and PFI energy
**Cooking temperature: 190° C.
***These values will increase by 5-6% if refining is on an industrial refiner.

Table 4 is a further example showing that at similar freeness the improved explosion pulp develops similar properties at lower energy as compared with a chemi-mechanical pulp (CMP).

TABLE 4

ULTRA HIGH YIELD PROCESSES - (SOFTWOOD)

| METHOD | CMP | IM-PROVED EXPLO-SION | CMP | IM-PROVED EXPLO-SION |
|---|---|---|---|---|
| CHEMICAL (%) ($Na_2SO_3$) | 13.5 | 8 | 13.5 | 8 |
| TEMPERATURE (%) | 160 | 190 | 160 | 190 |
| TIME (MIN) | 110 | 41 | 110 | 41 |
| YIELD (%) | 87 | 91.3 | 87 | 91.3 |
| CSF (ml) | 178 | 164 | 482 | 407 |
| SPECIFIC ENERGY of DEFIBRATOR (Mj/kg) | 8.9 | 4.0 | 6.7 | 3.9 |
| BURST (kPA · $M^2$/g) | 4.1 | 4.8 | 2.7 | 4.0 |
| TEAR (mN · $m^2$/g) | 10.6 | 9.4 | 12.9 | 10.5 |
| RUPTURE (km) | 6.9 | 7.3 | 4.7 | 5.9 |
| BRIGHTNESS (%) | 54.6 | 48.0 (54)*** | 54.6 | 48.9 (54)*** |
| OPACITY (%) | 88.2 | 91.8 | 87.4 | 92.1 |

*75% Spruce; 20% fir; 5% hardwood
**Blender Defibration
***After defibration in the Sunds Defibrator

Bleaching

The process of this invention is particularly suitable for bleaching with hydrogen peroxide. The formula of chemicals used for bleaching may also include sodium hydroxide, a substance such as magnesium sulphite and a complexing agent such as sodium diethylene triamine-pentacetate (DTPA). The improvement in brightness achieved at different concentrations is shown below in Table 5. It appears that up to about 4% hydrogen peroxide achieves progressive substantial improvements in brightness following which further additions are of questionable cost effectiveness.

TABLE 5

THE EFFECT OF THE CONCENTRATION OF $H_2O_2$ ON GAIN OF BRIGHTNESS (ASPEN)*

| | | | | | | |
|---|---|---|---|---|---|---|
| DTPA (%) | 0.1 | 0.1 | 0.1 | 0.1 | 0.1 | 0.1 |
| $MgSO_4$ (%) | 0.05 | 0.05 | 0.5 | 0.5 | 0.5 | 0.5 |
| NaOH (%) | 4.0 | 4.0 | 4.0 | 4.0 | 4.0 | 4.0 |
| $Na_2SiO_3$ (%) | 0.5 | 0.5 | 0.5 | 0.5 | 0.5 | 0.5 |
| $H_2O_2$ (%) | 1 | 2 | 3 | 4 | 6 | 10 |
| TEMPERATURE (°C.) | 70 | 70 | 70 | 70 | 70 | 70 |

TABLE 5-continued

THE EFFECT OF THE CONCENTRATION OF $H_2O_2$ ON GAIN OF BRIGHTNESS (ASPEN)*

| | | | | | | |
|---|---|---|---|---|---|---|
| TIME (min) | 120 | 120 | 120 | 120 | 120 | 120 |
| CONSISTENCY (%) | 20 | 20 | 20 | 20 | 20 | 20 |
| GAIN OF BRIGHTNESS (%) | 16.0 | 22.7 | 24.9 | 26.2 | 27.1 | 28.5 |
| OPACITY (%) | — | — | — | 77.6 | — | — |

*INITIAL BRIGHTNESS: 50.3%; (4% $Na_2SO_3$; 4 min, 190° C.)

Table 6 provides a further illustration of the effect of bleaching the products of the improved explosion process with hydrogen peroxide.

TABLE 6

CONDITIONS OF BLEACHING THE IMPROVED EXPLOSION PULPS WITH PEROXIDE

| PULP 8% $Na_2SO_3$ | BLACK SPRUCE | SPRUCE FIR | | ASPEN |
|---|---|---|---|---|
| 190° C.; 4 min | | | | |
| DTPA | 0.5 | 0.5 | 0.5 | 0.5 |
| $MgSO_4$ (%) | 0.05 | 0.05 | 0.05 | 0.05 |
| $Na_2SiO_3$ (%) | 1.0 | 1.00 | 0.5 | 0.5 |
| NaOH (%) | 2.0 | 2.0 | 4.0 | 4.0 |
| $H_2O_2$ (%) | 4.0 | 4.0 | 4.0 | 4.0 |
| TEMPERATURE (°C.) | 80 | 80 | 85 | 80 |
| TIME (MIN) | 150 | 150 | 150 | 150 |
| CONSISTENCY (%) | 20 | 20 | 25 | 20 |
| BRIGHTNESS | | | | |
| INITIAL | 46.5 (52.5)* | 49.3 (55.3)* | 52.4 | 70 (68)* |
| FINAL | 72.9 (78.9) | 75.9 (81.9) | 79.5 | 87 (85) |
| BRIGHTNESS GAIN (%) | 26.4 | 26.6 | 27.1 | 17 (17) |

*(after defibration in the Sunds Defibrator)

Various other factors involving bleaching conditions have been investigated. It was found that under conditions similar to those of Table 6 increasing the concentration of sodium silicate improved the increase of brightness up to about 3% sodium silicate, following which it dropped off. The gain of brightness increased with sodium hydroxide concentration up to peak at about 4% NaOH. Increase of consistency progressively improved the gain of brightness within the range investigated, which was up to 30%. Increasing the time improved the gain of brightness within the range investigated which was up to 4 hours.

Table 7 gives additional results showing the effect of bleaching with 4% hydrogen peroxide applied to the product of the improved explosion process as compared with CTMP pulp.

TABLE 7

THE EFFECT OF THE CONCENTRATION OF HYDROGEN PEROXIDE ON THE INDEX OF BLEACHING AND OPACITY

| | CTMP - ASPEN* | | IMPROVED EXPLOSION - ASPEN | | |
|---|---|---|---|---|---|
| % $H_2O_2$ | BRIGHTNESS (%) | OPACITY (%) | % $H_2O_2$ | BRIGHTNESS (%) | OPACITY |
| 0 | 60.9 | 91.4 | 0 | 69 | 89 |
| 4 | 77 | 75 | 4 | 87 | 74.5 |

*See TAPPI 69 (9) September 1986 pp. 130-133 B. V. Kokta and C. Deneault.

The preferred bleaching conditions for the improved explosion pulp are 3-5% hydrogen peroxide, 3-5% sodium hydroxide; 0.5 to 3% sodium silicate; 0 to 0.1% magnesium sulphate, time 1 hour to 4 hours, temperature 50° C. to 90° C., consistency 10 to 35%. DTPA 0 to 0.5%. These conditions should give a good compromise between cost and effectiveness. The most important chemical additives are the hydrogen peroxide and the sodium hydroxide.

In order the protect brightness stability and prevent reversion, the pulp should be washed, preferably with a solution of sodium metabisulphite (for example a 2% solution) or a solution of water saturated with sulphur dioxide. These solutions will provide sulphur dioxide which will react with and neutralize the excess of hydrogen peroxide.

In conclusion, it may be expected that the improved explosion process will provide a product having a yield in the range 90 to 94% and an energy of defibration of 3 to 4.9 MJ/kg in one stage refining or 4 to 6.5 MJ/kg in two stage refining. In the case of softwoods, the brightness without bleaching will be in the range 55-60% and after bleaching with 4% hydrogen peroxide will have a brightness in the range 80-82%. Hardwood will have a brightness without bleaching in the range 60-70% and after bleaching with 4% hydrogen peroxide will have a brightness of 85-87%. The physical properties of softwood are comparable or superior to those produced by the CMP or CTMP processes. The properties of the hardwood are up to 50% superior to the products produced by the CMP or CTMP processes. It is reasonable to expect that, by applying the principles disclosed herein further optimization will result in even better results.

I claim:

1. A process for making paper making pulp comprising the step of:

(1) thoroughly impregnating wood fragments having fibers suitable for paper making in the substantial absence of air with an alkaline aqueous liquor including at least one agent acting to provide hydrophilic groups and as an antioxidant to impregnate enough of said agent throughout the wood fragments to protect the wood fragments from acidic hydrolysis and oxidative degradation during subsequent cooking;

(2) steam cooking the impregnated chips in direct contact with saturated steam in the substantial absence of air at superatmospheric pressure and a temperature within the range of about 170° C. to 210° C.;

(3) subjecting the wood fragments to explosive decompression to give wood fragments that are softened and partially defibrated;

(4) without undue delay that would result in brightness loss, refining the softened and defibrated chips to provide pulp.

2. A process as in which the temperature of steam cooking is in the range 180° C. to 195° C.

3. A process as in claim 1, in which the aqueous liquor used for impregnating is at a pH of at least 7.5 and the final pH following steam cooking is at least 6.

4. A process as in claim 1, in which the wood fragments are chips.

5. A process as in claim 1, in which the wood fragments are shredded chips.

6. A process as in claim 1, in which the aqueous liquor used for impregnating includes a swelling agent.

7. A process as in claim 1, in which the aqueous liquor used for impregnating includes a swelling agent selected from the group consisting of sodium hydroxide, potassium hydroxide and ammonium hydroxide in an amount of 1 to 3% of the aqueous liquor.

8. A process as in claim 1, in which the hydrophilic and antioxidant agent is sodium sulphite.

9. A process as in claim 1, in which the hydrophilic and antioxidant agent is selected from the group consisting of sodium sulphite, potassium sulphite and magnesium sulphite in an amount of 1-10% absorbed by the wood fragments.

10. A process as in claim 1, in which the aqueous liquor comprises a complexing agent selected from the group consisting of ethylene diamine tetra-acetic acid, sodium diethylene triaminepentacetate and sodium tripolyphosphate.

11. A process as in claim 1, in which the time of cooking is in the range 30 seconds to 6 minutes.

12. A process as in claim 1, in which the time of cooking is in the range 1 to 4 minutes.

13. A process as in claim 1, in which the temperature of cooking is in the range 180° C. to 195° C. and the time of cooking is in the range 1 to 4 minutes.

14. A process as in claim 1, in which the resultant pulp is bleached with hydrogen peroxide.

15. A process as in claim 1, in which the resultant pulp is hardwood having a brightness of at least 60 without bleaching.

16. A process as in claim 1, in which the resultant pulp is softwood having a brightness of at least 55 without bleaching.

17. A process as in claim 1, in which the resultant pulp is hardwood bleached with less than 5% hydrogen peroxide to a brightness of at least 85.

18. A process as in claim 1, in which the resultant pulp is softwood bleached with less than 5% hydrogen peroxide to a brightness of at least 80.

19. A process as in claim 1, in which the resultant pulp is bleached using 3-5% hydrogen peroxide and 3-5% sodium hydroxide.

20. A process as in claim 1, in which the resultant pulp is bleached using 3–5% hydrogen peroxide, 3–5% sodium hydroxide, 0.5 to 3% sodium silicate, 0 to 0.1% magnesium sulphate, 0 to 1% diethylene triamine pentacetate at a temperature of 50° C. to 90° C., time 1 hour to 4 hours and a consistency of 10 to 35%.

21. A process as in claim 1, in which the resultant pulp is bleached using 3–5% hydrogen peroxide and 3–5% sodium hydroxide, and in which the pulp is washed with a washing solution which will neutralize excess hydrogen peroxide to obtain a final pH of about 5.5.

22. A process as in claim 1, in which the resultant pulp is bleached using 3–5% hydrogen peroxide and 3–5% sodium hydroxide, and in which the pulp is washed with a washing solution which will neutralize excess hydrogen peroxide to obtain a final pH of about 5.5, and in which such washing solution comprises sulphur dioxide.

23. A process as in claim 1, in which the hydrophilic and antioxidant agent is sodium sulphite in the amount of about 4–8%.

* * * * *